US007676165B2

(12) United States Patent
Hayashi

(10) Patent No.: US 7,676,165 B2
(45) Date of Patent: Mar. 9, 2010

(54) IMAGE FORMING APPARATUS AND CONTROL METHOD THEREFOR

(75) Inventor: Hiroko Hayashi, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 241 days.

(21) Appl. No.: 11/859,286

(22) Filed: Sep. 21, 2007

(65) Prior Publication Data

US 2008/0075489 A1 Mar. 27, 2008

(30) Foreign Application Priority Data

Sep. 26, 2006 (JP) ..... 2006-261417
Jul. 5, 2007 (JP) ..... 2007-177558
Aug. 29, 2007 (JP) ..... 2007-223093

(51) Int. Cl.
*G03G 13/00* (2006.01)

(52) U.S. Cl. ..... 399/45; 399/66; 399/68; 399/302

(58) Field of Classification Search ..... 399/45, 399/66, 68, 302
See application file for complete search history.

(56) References Cited

U.S. PATENT DOCUMENTS 7,043,170 B2 5/2006 Ono et al.
2008/0075489 A1* 3/2008 Hayashi ..... 399/45

FOREIGN PATENT DOCUMENTS

JP 2004-020616 A 1/2004

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

This invention provides an image forming apparatus capable of adjusting the image sync signal output timing in the sub-scanning direction and the speed of a primary transfer process so as to obtain a proper throughput of a printer engine when successively forming images, and a control method therefor. To accomplish this, when the speed of an intermediate transfer member is to change upon changing the print speed, a toner image to be secondarily transferred after changing the speed is primarily transferred at an intermediate transfer member speed before the change. After the speed of the intermediate transfer member is switched, the image primarily transferred before changing the speed is secondarily transferred. Primary transfer, which has conventionally been performed after changing the print speed, can be executed before changing the print speed.

7 Claims, 11 Drawing Sheets

FIG. 4B

| PRIMARY TRANSFER SPEED $V_a$ BEFORE CHANGE | PRIMARY TRANSFER SPEED $V_b$ AFTER CHANGE | DISTANCE (MOVING TIME) $L_c$ NECESSARY TO CHANGE PRIMARY TRANSFER SPEED | DISTANCE (MOVING TIME) $L_x$ NECESSARY TO CHANGE PRINT SPEED |
|---|---|---|---|
| $V_1$ | $V_2$ | $L_{c1}(t_{11})$ | $L_{x1}(t_{12})$ |
| $V_2$ | $V_1$ | $L_{c2}(t_{21})$ | $L_{x2}(t_{22})$ |
| ... | ... | ... | ... |

IMAGE FORMING APPARATUS AND CONTROL METHOD THEREFOR

BACKGROUND OF THE INVENTION

1. Field of the Invention

The present invention relates to an image forming apparatus such as a printer or copying apparatus, a control method therefor, a control program, and a storage medium and, more particularly, to a technique of controlling the print speed of an image forming apparatus having an intermediate transfer member.

2. Description of the Related Art

In printing on a transfer medium with a large heat capacity such as an OHP film, thick paper, or envelop, a full-color image forming apparatus decreases the transfer medium conveying speed in comparison with that in printing on normal plain paper, in order to avoid degradation of the fixing performance of a fixing unit. This operation prolongs the time during which a transfer medium passes through the fixing unit. The amount of heat applied from the fixing unit to the transfer medium can increase, and the fixing temperature can rise to a high level. Even when printing on a transfer medium with a large heat capacity, a stable fixing characteristic can be ensured without degrading the fixing performance of the fixing unit.

In a conventional one-drum type full-color image forming apparatus having an intermediate transfer member, a toner image is formed on the photosensitive member and is transferred onto the intermediate transfer member (to be referred to as primary transfer hereinafter). In primary transfer, the photosensitive member and intermediate transfer member rotate at a normal print speed. Then, the driving speed is switched to perform a subsequent process of transferring a toner image from the intermediate transfer member onto a transfer medium (to be referred to as secondary transfer hereinafter). However, the one-drum type image forming apparatus takes a long primary transfer time because toner images developed using one photosensitive member and a plurality of developing units are superposed and transferred onto the intermediate transfer member for each respective color.

These days, a four-drum type image forming apparatus has appeared, which can simultaneously form toner images in respective colors on the intermediate transfer member by using four photosensitive members and developing units. In the four-drum type image forming apparatus, the first toner image is formed on the first photosensitive member and primarily transferred from the photosensitive member onto the intermediate transfer member. Then, the second toner image is formed on the second photosensitive member and transferred over the first toner image on the intermediate transfer member. This operation is continuously executed for four photosensitive members (e.g., B, C, M, and Y photosensitive members). As a result, a color image is formed from the four superposed toner images on the intermediate transfer member. The color image formed on the intermediate transfer member is secondarily transferred from the intermediate transfer member to a transfer medium at the secondary transfer position (e.g., Japanese Patent Laid-Open No. 2004-020616).

When successively forming images based on a plurality of print jobs, the four-drum type image forming apparatus parallel-executes a primary transfer process for a subsequent print job and a secondary transfer process for a preceding print job. For this reason, the primary and secondary transfer processes are equal in speed. When the print speed is to be switched upon changing the print mode or the like, image forming processes such as the primary and secondary transfer processes temporarily end. Then, the primary and secondary transfer units switch to a print speed corresponding to the selected mode, and the image forming processes start again.

The above-mentioned four-drum type image forming apparatus with an intermediate transfer member requires a longer length from the position of the primary transfer unit for performing the primary transfer process to that of the secondary transfer unit for performing the secondary transfer process. To switch the print speed, an image forming process in progress must be temporarily stopped. This prolongs the time until the next primary transfer process is executed.

If the image forming process is to restart from the primary transfer process of an image after switching the speeds of the primary and secondary transfer units upon switching the print speed, like the prior art, the throughput greatly decreases upon speed switching.

SUMMARY OF THE INVENTION

The present invention enables realization of an image forming apparatus capable of adjusting the image sync signal output timing in the subscanning direction and the speed of a primary transfer process so as to obtain a proper throughput of a printer engine when successively forming images, and a control method therefor.

According to one aspect of the present invention, an image forming apparatus which primarily transfers a formed toner image onto an intermediate transfer member at a primary transfer position, and secondarily transfers the primarily transferred toner image onto a printing medium at a secondarily transfer position, the apparatus comprising:

a determination unit adapted to determine whether to change a rotation speed of the intermediate transfer member;

a toner image forming unit adapted to, when the determination unit determines to change the rotation speed, primarily transfer, onto the intermediate transfer member, a toner image which is to be secondarily transferred onto the printing medium from the intermediate transfer member at a second speed by using, as a start position, a position spaced apart, by at least a distance necessary to change the rotation speed from a first speed to the second speed, from a position of a back end of a final toner image before changing a speed that is to be secondarily transferred onto the printing medium from the intermediate transfer member at the first speed; and a speed change unit adapted to start changing the rotation speed from the first speed to the second speed after the back end of the final toner image before changing the speed is secondarily transferred onto the printing medium from the intermediate transfer member at the first speed.

According to another aspect of the present invention, a method of controlling an image forming apparatus which primarily transfers a formed toner image onto an intermediate transfer member at a primary transfer position, and secondarily transfers the primarily transferred toner image onto a printing medium at a secondarily transfer position, the method comprising the steps of:

determining whether to change a rotation speed of the intermediate transfer member;

when the rotation speed is determined in the determining step to change, primarily transferring, onto the intermediate transfer member, a toner image which is to be secondarily transferred onto the printing medium from the intermediate transfer member at a second speed by using, as a start position, a position spaced apart, by at least a distance necessary to change the rotation speed from a first speed to the second speed, from a position of a back end of a final toner image before changing a speed that is to be secondarily transferred onto the printing medium from the intermediate transfer member at the first speed; and starting changing the rotation speed from the first speed to the second speed after the back end of the final toner image before changing the speed is secondarily transferred onto the printing medium from the intermediate transfer member at the first speed.

According to still another aspect of the present invention, a computer program which causes a computer to execute a method of controlling an image forming apparatus which primarily transfers a formed toner image onto an intermediate transfer member at a primary transfer position, and secondarily transfers the primarily transferred toner image onto a printing medium at a secondary transfer position, the computer program comprising the steps of:

determining whether to change a rotation speed of the intermediate transfer member;

when the rotation speed is determined in the determining step to change, primarily transferring, onto the intermediate transfer member, a toner image which is to be secondarily transferred onto the printing medium from the intermediate transfer member at a second speed by using, as a start position, a position spaced apart, by at least a distance necessary to change the rotation speed from a first speed to the second speed, from a position of a back end of a final toner image before changing a speed that is to be secondarily transferred onto the printing medium from the intermediate transfer member at the first speed; and starting changing the rotation speed from the first speed to the second speed after the back end of the final toner image before changing the speed is secondarily transferred onto the printing medium from the intermediate transfer member at the first speed.

According to yet another aspect of the present invention, an image forming method of primarily transferring a formed toner image onto an intermediate transfer member at a primary transfer position, and secondarily transferring the primarily transferred toner image onto a printing medium at a secondary transfer position, the method comprising the steps of:

primarily transferring, onto the intermediate transfer member moving at a first speed, a first toner image which is to be secondarily transferred onto a printing medium at the first speed;

primarily transferring, onto the intermediate transfer member moving at the first speed at an interval corresponding to a time taken to change a moving speed of the intermediate transfer member from the first speed to the second speed, a second toner image which is successive to the first toner image and is to be secondarily transferred onto a printing medium at the second speed different from the first speed;

secondarily transferring the first toner image onto the printing medium from the intermediate transfer member moving at the first speed;

changing the moving speed of the intermediate transfer member to the second speed after secondarily transferring the first toner image onto the printing medium; and secondarily transferring the second toner image onto the printing medium from the intermediate transfer member moving at the second speed after changing the moving speed of the intermediate transfer member to the second speed.

Further features of the present invention will be apparent from the following description of exemplary embodiments with reference to the attached drawings.

BRIEF DESCRIPTION OF THE DRAWINGS

FIG. 4B is a table showing a comparison in the intermediate transfer member moving distance (moving time) necessary to change the primary transfer speed, and the image forming interval (moving time) when changing the primary transfer speed;

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

[Features]

An image forming apparatus according to a first embodiment has a feature of reducing an increase in print time upon switching the print speeds when images are successively printed using transfer media with different heat capacities (fixing speeds), as compared with a conventional process. In a conventional print reservation process, when a print job at a print speed $V_1$ and a print job at a print speed $V_2$ are to be successively performed, primary transfer and secondary transfer are done at the print speed $V_1$, and the print speed switches from $V_1$ to $V_2$. Then, primary transfer and secondary transfer are done at the print speed $V_2$ for the print job including speed change. In a print reservation process according to the embodiment, however, primary transfer of part of a print job including speed change is done at the primary transfer speed $V_1$ before changing the speed. After the print speed switches from $V_1$ to $V_2$, secondary transfer of the image primarily transferred at the print speed $V_1$, and primary transfer and secondary transfer of the remaining print job including speed change are performed at the print speed $V_2$. According to the embodiment, before changing the print speed, primary transfer of part of a print job including speed change is executed, which has conventionally been done after changing the print speed. Thus, the image forming apparatus can provide the user with printed materials more quickly than by the conventional process.

The image forming apparatus according to the present invention will be described in detail below with reference to the accompanying drawings.

Figure 1A:
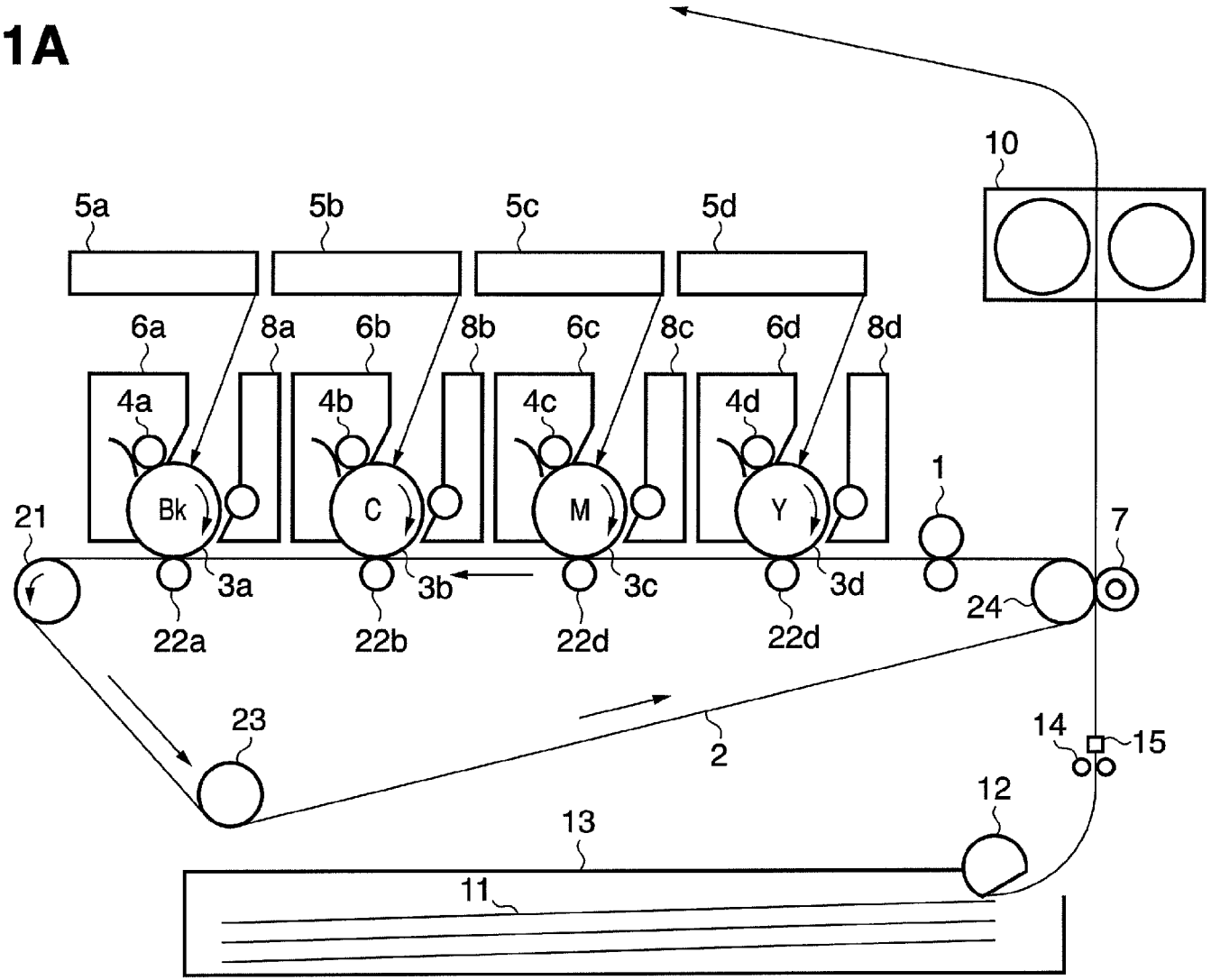
FIG. 1A is a sectional view showing a schematic structure of a color image forming apparatus according to an embodiment.

[Image Forming Apparatus: FIG. 1A]

FIG. 1A is a sectional view showing the schematic structure of a color image forming apparatus as an example of the image forming apparatus according to the present invention.

The color image forming apparatus according to the embodiment comprises four image carriers 3*a*, 3*b*, 3*c*, and 3*d* which have a negative normal charging polarity and bear toner images in black, cyan, magenta and yellow. In the embodiment, the image carriers 3*a*, 3*b*, 3*c*, and 3*d* are photosensitive drums (drum-shaped electrophotographic photosensitive members) arranged in series. The photosensitive drums 3*a*, 3*b*, 3*c*, and 3*d* are surrounded by primary charging units 4*a*, 4*b*, 4*c*, and 4*d*, developing units 8*a*, 8*b*, 8*c*, and 8*d*, and cleaning units 6*a*, 6*b*, 6*c*, and 6*d* in correspondence with the respective photosensitive drums. Exposure units 5*a*, 5*b*, 5*c*, and 5*d* are arranged above the photosensitive drums 3*a*, 3*b*, 3*c*, and 3*d*.

The charging rollers 4*a*, 4*b*, 4*c*, and 4*d*, in contact with the photosensitive drums 3*a*, 3*b*, 3*c*, and 3*d*, negatively charge the photosensitive drums 3*a*, 3*b*, 3*c*, and 3*d*. The exposure units 5*a*, 5*b*, 5*c*, and 5*d* expose the photosensitive drums 3*a*, 3*b*, 3*c*, and 3*d* to optical images color-separated into black, cyan, magenta and yellow. As a result, black, cyan, magenta and yellow latent images are formed on the photosensitive drums 3*a*, 3*b*, 3*c*, and 3*d*. The developing units 8*a*, 8*b*, 8*c*, and 8*d* reversely develop the respective latent images, sequentially forming black, cyan, magenta and yellow toner images on the photosensitive drums 3*a*, 3*b*, 3*c*, and 3*d*.

An intermediate transfer belt (to be referred to as an ITB hereinafter) 2 is arranged as an intermediate transfer member (image carrier) below the photosensitive drums 3*a*, 3*b*, 3*c*, and 3*d*. The ITB 2 is looped between a roller 21 for driving the intermediate transfer belt, and rollers 22*a*, 22*b*, 22*c*, 22*d*, 23, and 24. The ITB 2 rotates in a direction indicated by arrows at almost the same speed as the photosensitive drums 3*a*, 3*b*, 3*c*, and 3*d*. Toner images formed on the photosensitive drums 3*a*, 3*b*, 3*c*, and 3*d* are electrostatically primarily transferred onto the outer surface of the ITB 2 by a primary transfer bias (voltage of positive polarity) applied to the primary transfer rollers 22*a*, 22*b*, 22*c*, and 22*d* of the primary transfer unit. The ITB 2 bears toner images in a plurality of colors. These building elements function as a toner image forming unit.

Paper 11 is fed by a pickup roller 12 from a paper cassette 13, reaches a registration sensor 15, and stops. The paper is fed again by registration conveyance rollers 14 at a predetermined timing. At the same time, a secondary transfer bias (voltage of positive polarity) is applied to a secondary transfer roller 7 serving as a secondary transfer device, electrostatically transferring toner images from the ITB 2 to the paper 11. The paper 11 is conveyed to a fixing unit 10 by the registration conveyance rollers 14 and secondary transfer roller 7. The transferred toner images are fused and fixed, obtaining a color image.

A contact charging unit 1 serving as an ITB cleaning unit (charging unit) charges toner (residual secondary transfer toner) remaining on the ITS 2 after the end of secondary transfer to a polarity reverse to the normal charging polarity. The ITB 2 moves to supply the residual transfer toner charged to the reverse polarity again to the primary transfer unit. By a primary transfer bias of positive polarity (voltage of a polarity reverse to the toner charging polarity) applied to the primary transfer roller 22*d*, the residual transfer toner is reversely transferred onto the photosensitive drum 3*d* serving as the counter electrode of the primary transfer roller 22*d*. In this case, the residual secondary transfer toner is recovered by the cleaning unit 6*d* arranged in correspondence with the photosensitive drum 3*d* of the first color. The ITB cleaning unit 1, that is, charging roller serving as a charging unit is always in contact with the ITB 2.

Figure 1B:
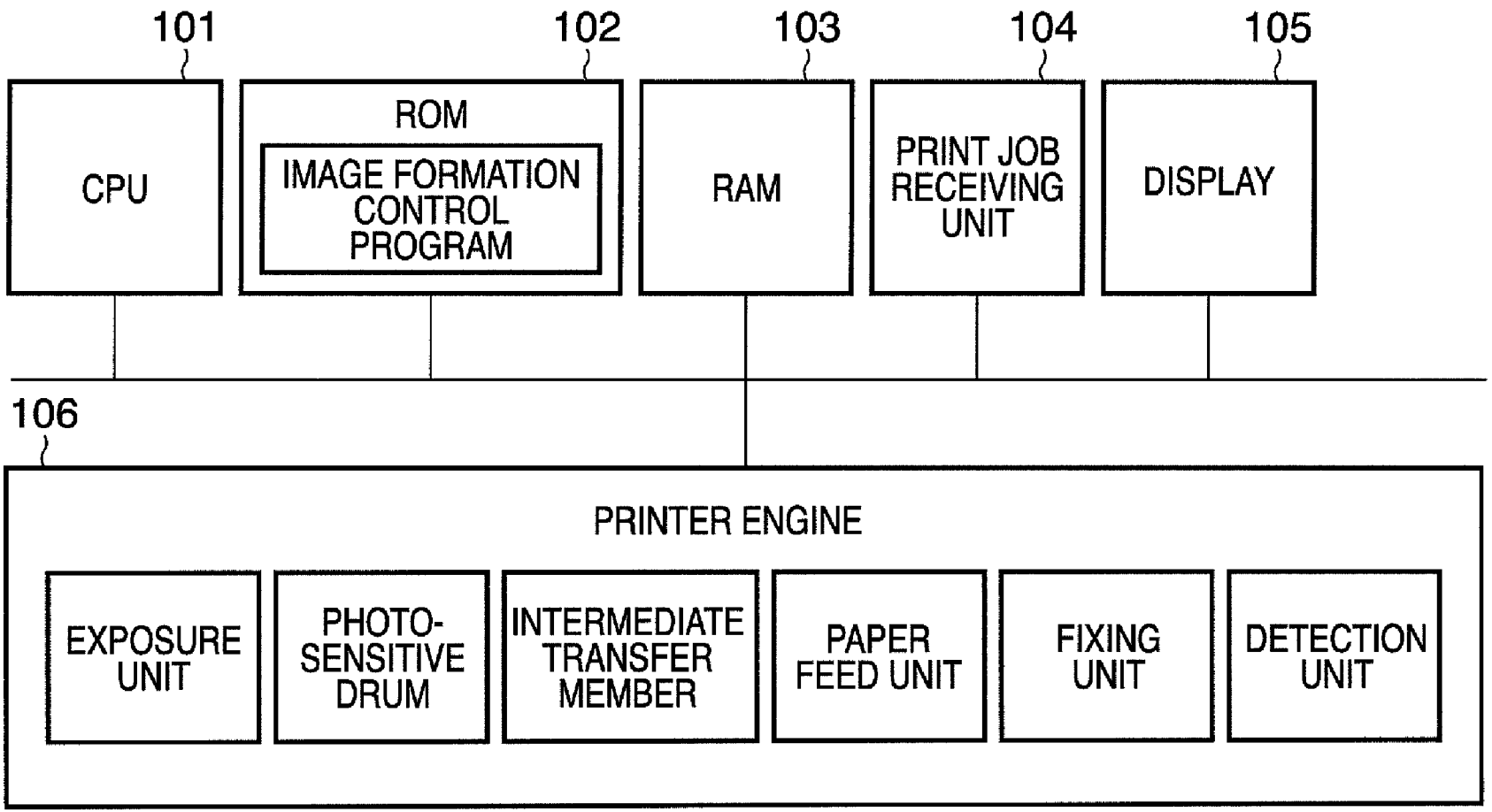
FIG. 1B is a block diagram showing a control arrangement of the color image forming apparatus according to the embodiment.

[Control Arrangement of Image Forming Apparatus: FIG. 1B]

FIG. 1B is a block diagram showing the control arrangement of the image forming apparatus shown in FIG. 1A.

A CPU 101 controls the overall image forming apparatus. A ROM 102 stores various control programs and various data. Reference numeral 103 denotes a RAM; 104, a print job receiving unit; 105, a display; and 106, a printer engine. The printer engine 106 includes an exposure unit, photosensitive drum, intermediate transfer member, paper feed unit, fixing unit, and detection unit. The CPU 101 can perform a variety of processes while controlling respective units using the RAM 103 as a work area based on an image formation control program stored in the ROM 102. For example, the CPU 101 can execute an adjustment process to reduce an increase in image forming time upon switching the print speed when images are successively formed using different types of printing media requiring switching of the print speed.

Figure 1C:
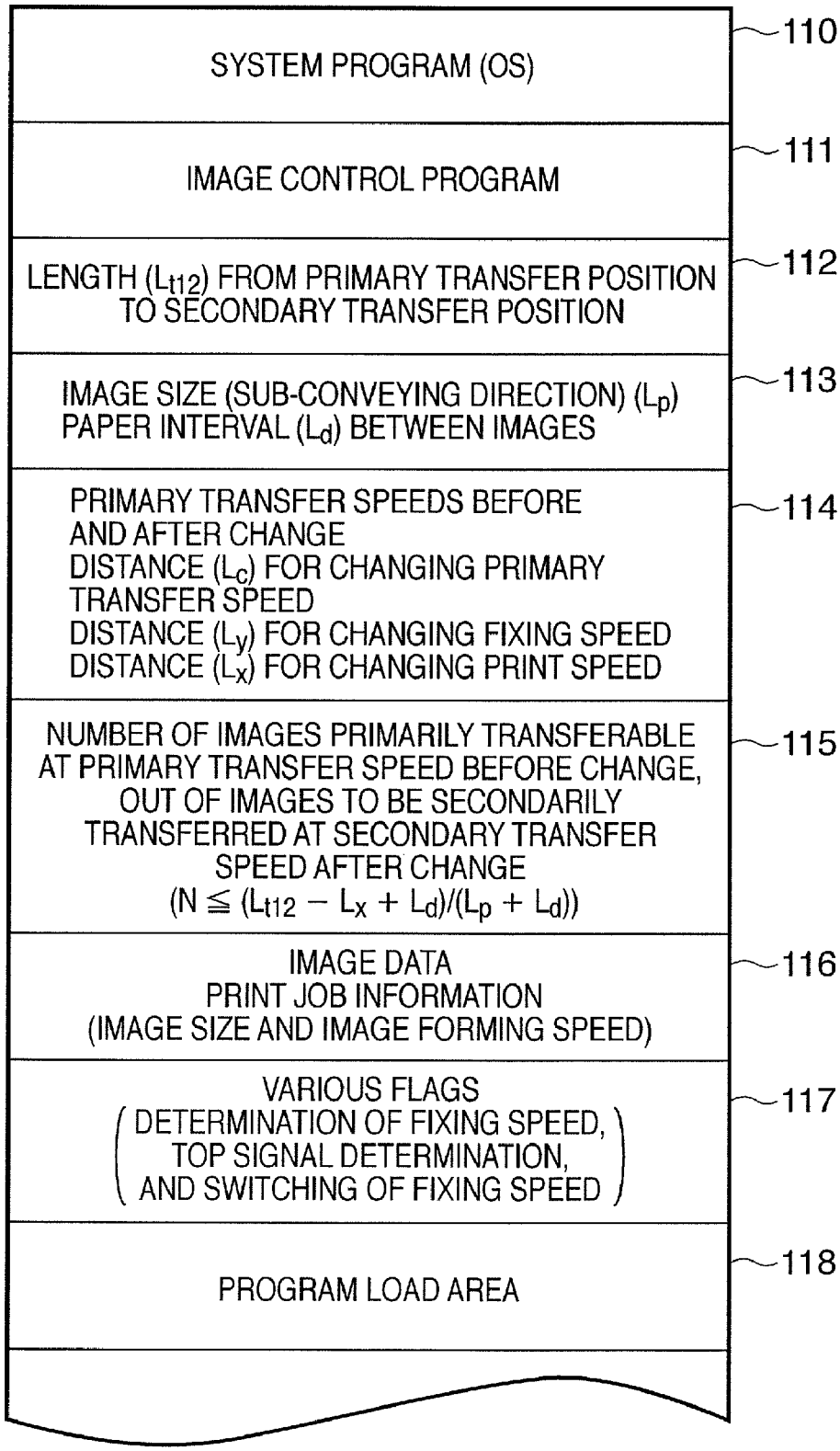
FIG. 1C is a view for explaining a ROM/RAM structure.

[ROM/RAM Structure: FIG. 1C]

Structures of the ROM 102 and RAM 103 will be described with reference to FIG. 1C. FIG. 1C illustrates data necessary for a description of the embodiment, and does not illustrate those not necessary for the description.

An area 110 in the ROM 102 stores a system program, an area 111 stores an image control program, and an area 112 stores a length $L_{t12}$ (see FIG. 3) from the primary transfer position to secondary transfer position of the photosensitive drum 3*a* of the fourth color. An area 113 stores the lengths $L_p$ (see FIG. 3) of various image sizes in the sub-conveying direction, and the paper distance $L_d$ (see FIG. 3) between images at the same primary transfer speed. The distance $L_d$ represents a printing medium conveying interval. An area 114 stores primary transfer speeds before and after change, and a distance $L_c$ (moving time) necessary to change the primary transfer speed, as shown in FIG. 4B. The distance necessary to change the primary transfer speed is one necessary to change the rotation speed of the intermediate transfer member after the back end position of a final toner image formed at a primary transfer speed before change. The "distance" in the embodiment means the length of the intermediate transfer member in the conveying direction. A position spaced apart by at least the distance $L_c$ from the back end position of the toner image is the image formation start position after changing the speed. The area 114 also stores fixing unit speeds before and after change, a paper conveying distance $L_y$ (moving time) necessary to change the fixing unit speed, and an image interval $L_x$ when changing the print speed. An area 115 stores an equation to calculate the number of images primarily transferable at a primary transfer speed before change, out of images which are secondarily transferred at a secondary transfer speed after change.

An area 116 in the RAM 103 stores image data to be formed by each print job, and print job information (image size, type of printing medium for use, and print speed). An area 117 stores various flags (comparison and determination of the fixing speed of a print job, TOP signal/speed switching, and completion of secondarily transferring a preceding image) necessary to execute a program in FIG. 2. An area 118 serves as a program load area.

<Image Forming Method Including Switching of Fixing Speed in Embodiment>

A print reservation process including switching of the fixing speed using the image forming apparatus according to the embodiment will be described. An outline and details of the difference in the print reservation method between the embodiment and the prior art will be explained. Then, the number of images primarily transferred before switching the fixing speed for a print job including switching of the fixing speed, and the transfer position of the primarily transferred image will be explained. Finally, the sequence of the print reservation process including switching of the fixing speed will be explained.

[1. Difference in Print Reservation Process Between Embodiment and Prior Art]

[Outline]

In a conventional print reservation process, when a print job at the print speed $V_1$ and a print job at the print speed $V_2$ are to be successively performed, primary transfer and secondary transfer are done at the print speed $V_1$. After the print speed switches from $V_1$ to $V_2$, primary transfer and secondary transfer are done at the print speed $V_2$ for the print job including speed change. In a print reservation process according to the embodiment, however, primary transfer of part of a print job including speed change is performed at the primary transfer speed $V_1$ before changing the speed. After the print speed switches from $V_1$ to $V_2$, secondary transfer of the image primarily transferred at the print speed $V_1$, and primary transfer and secondary transfer of the remaining print job including speed change are performed at the print speed $V_2$. According to the embodiment, before changing the print speed, primary transfer of part of a print job including speed change is executed, which has conventionally been done after changing the print speed. The image forming apparatus can, therefore, provide the user with printed materials more quickly than by the conventional process. The difference in the print reservation process between the prior art and the embodiment will be described in detail with reference to FIGS. 3 and 4A.

Figure 3:
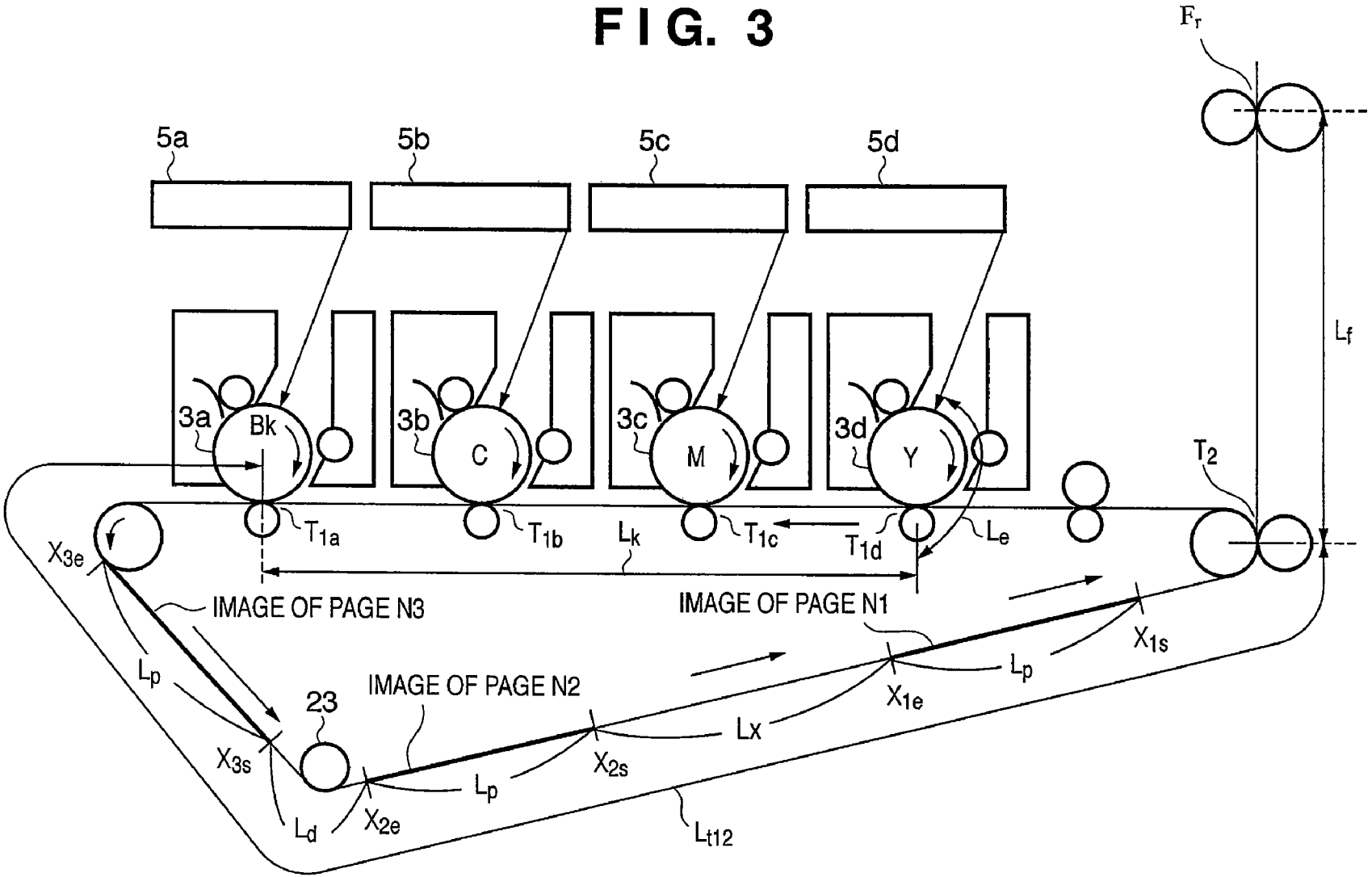
FIG. 3 is a sectional view for explaining a process from primary transfer to secondary transfer in the image forming apparatus according to the first embodiment.
Figure 4A:
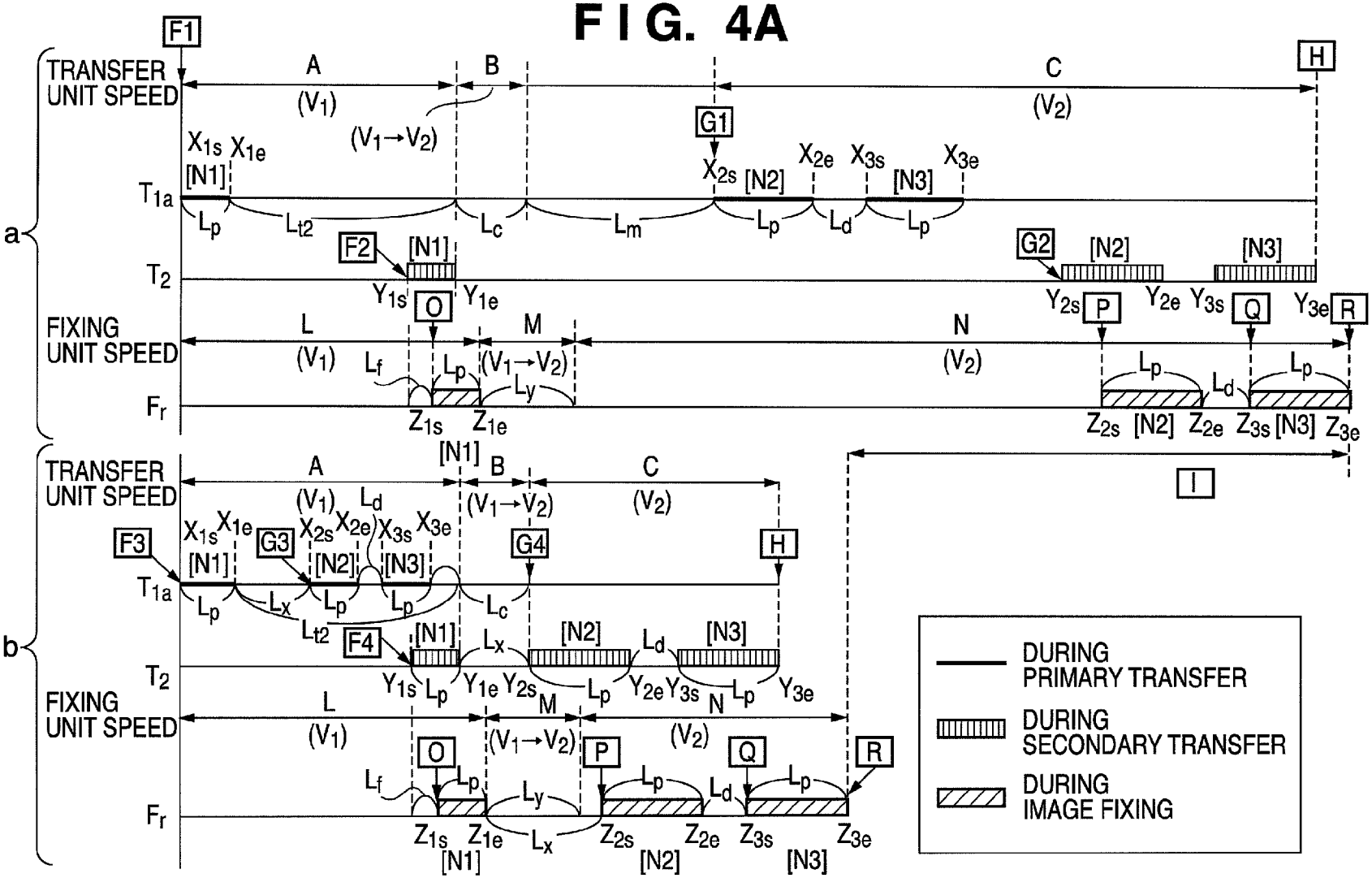
FIG. 4A is a view showing a comparison in the time taken to end secondary transfer in a print reservation process between the prior art and the embodiment.

[Details of Difference in Print Reservation Process: FIGS. 3 and 4A]

FIG. 3 will be explained. FIG. 3 is a sectional view showing the positional relationship between the primary transfer position, intermediate transfer member, and secondary transfer position (printing medium transfer position) associated with a process from primary transfer to secondary transfer in the image forming apparatus. In the example of FIG. 3, as for the images of pages N1 to N3 having the same image size, the page N1 is printed at the first print speed $V_1$, and the pages N2 and N3 are printed at the second print speed $V_2$ lower than the first print speed $V_1$. In FIG. 3, $L_{t12}$ represents the distance from a transfer roller $T_{1a}$ of the final station (black station in this example) of the primary transfer unit to the secondary transfer roller $T_2$. $L_f$ represents the distance from the secondary transfer roller $T_2$ to a fixing roller $F_r$. $L_p$ represents the length of the image size in the subscanning direction. $L_x$ represents an intermediate transfer member moving distance corresponding to the image interval between the pages N1 and N2 (images at different print speeds) on the intermediate transfer member. $L_d$ represents the paper interval between the pages N2 and N3. $L_k$ represents the distance from a primary transfer position $T_{1d}$ of the photosensitive drum 3*d* of the first color to the primary transfer position $T_{1a}$ of the photosensitive drum 3*a* of the fourth color. $L_e$ represents the distance from the exposure position of the exposure unit 5*d* on the photosensitive drum 3*d* of the first color to the primary transfer position $T_{1d}$ of the photosensitive drum 3*d*. Assume that $L_k+L_e=L_m$. That is, $L_m$ represents the distance from an exposure position on the photosensitive drum 3*d* of the first color to the primary transfer position $T_{1a}$ of the photosensitive drum 3*a* of the fourth color. $L_c$ represents an intermediate transfer member moving distance necessary to change the rotation speed (=primary transfer speed and secondary transfer speed) of the intermediate transfer member from the first speed $V_1$ to the second speed $V_2$. $L_y$ represents an intermediate transfer member moving distance necessary to change the fixing unit speed from the first speed $V_1$ to the second speed $V_2$. In this case, $L_x \geqq L_c$ and $L_x \geqq L_y$.

FIG. 4A will now be explained. FIG. 4A is a schematic view showing a comparison in the time taken to end image fixing in the print reservation process between the prior art and the embodiment. FIG. 4A shows a comparison when, of images having the same image size shown in FIG. 3, the image of the page N1 is printed at the first print speed $V_1$ and those of the pages N2 and N3 are printed at the second print speed $V_2$ (=$V_1/2$) lower than the first print speed $V_1$.

(a) in FIG. 4A shows the conventional print reservation process. The image of the page N1 is primarily and secondarily transferred at the print speed $V_1$. After the print speed is switched, primary transfer and secondary transfer of the images of the pages N2 and N3 start at the switched print speed. In section A in (a) of FIG. 4A, primary transfer and secondary transfer of the page N1 are done at the speed $V_1$. In section B, the rotation speeds of the primary transfer unit and intermediate transfer member change from the speed $V_1$ to the speed $V_2$. In section C, primary transfer and secondary transfer of the pages N2 and N3 are done at $V_2$. F1 indicates the start of primary transfer of the page N1 in the final station. F2 indicates the start of secondary transfer of the page N1. G1 indicates the start of primary transfer of the page N2 in the final station. G2 indicates the start of secondary transfer of the page N2. H indicates the end of secondary transfer of the page N3. In section L, the image of the page N1 is fixed at the speed $V_1$. In section M, the fixing unit speed changes from the speed $V_1$ to the speed $V_2$. In section N, the images of the pages N2 and N3 are fixed at $V_2$. O indicates the start of image fixing of the page N1. P indicates the start of image fixing of the page N2. Q indicates the start of image fixing of the page N3. R indicates the end of image fixing of the page N3.

More specifically, primary transfer of the page N1 starts from $X_{1s}$ at the primary transfer position $T_{1a}$ at the primary transfer speed $V_1$ and ends at $X_{1e}$. Secondary transfer of the page N1 starts from $Y_{1s}$ at the secondary transfer position $T_2$ at the secondary transfer speed $V_1$ and ends at $Y_{1e}$. Image fixing of the page N1 starts from $Z_{1s}$ at the image fixing position $F_r$ at the fixing speed $V_1$ and ends at $Z_{1e}$. Primary transfer of the page N2 starts from $X_{2s}$, at the primary transfer position $T_{1a}$ at the primary transfer speed $V_2$ and ends at $X_{2e}$. Secondary transfer of the page N2 starts from $Y_{2s}$ at the secondary transfer position $T_2$ at the secondary transfer speed $V_2$ and ends at $Y_{2e}$. Image fixing of the page N2 starts from $Z_2$, at the image fixing position $F_r$ at the fixing speed $V_2$ and ends at $Z_{2e}$. Similarly, primary transfer of the page N3 starts from $X_{3s}$ at the primary transfer position $T_{1a}$ at the primary transfer speed $V_2$ and ends at $X_{3e}$. Secondary transfer of the page N3 starts from $Y_{3s}$ at the secondary transfer position $T_2$ at the secondary transfer speed $V_2$ and ends at $Y_{3e}$. Image fixing of the page N3 starts from $Z_{3s}$ at the image fixing position $F_r$ at the fixing speed $V_2$ and ends at $Z_{3e}$.

Figure 2:
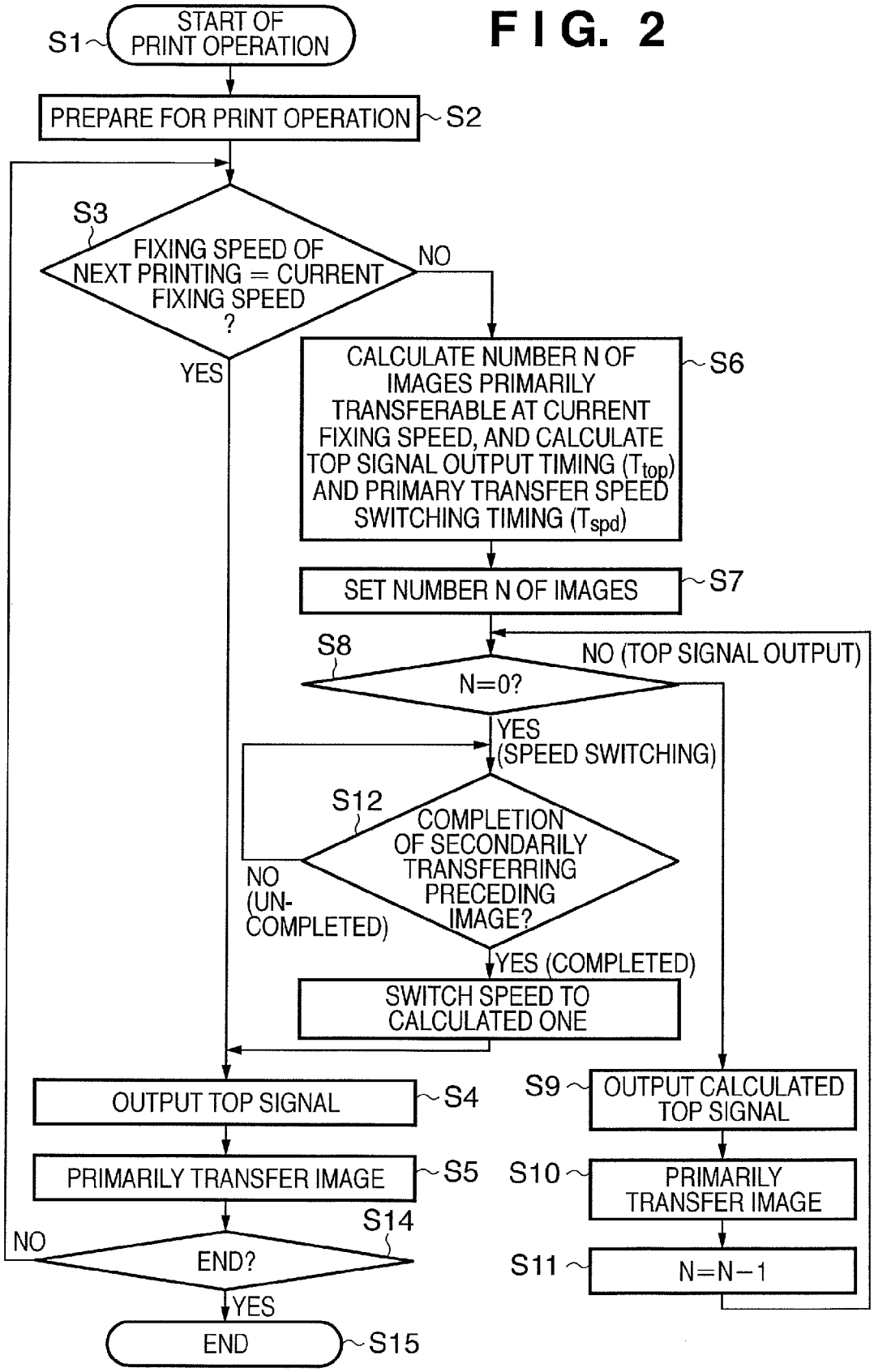
FIG. 2 is a flowchart for explaining a primary transfer process in an image forming apparatus according to a first embodiment.

(b) in FIG. 4A shows the print reservation process according to the embodiment shown in FIG. 2. In section A in (b) of FIG. 4A, primary transfer of the pages N1 to N3 and secondary transfer of the page N1 are done at the speed $V_1$. In section B, the rotation speeds of the primary transfer unit and intermediate transfer member change from the speed $V_1$ to $V_2$. In section C, secondary transfer of the pages N2 and N3 is done at the speed $V_2$. F3 indicates the start of primary transfer of the page N1 in the final station. F4 indicates the start of secondary transfer of the page N1. G3 indicates the start of primary transfer of the page N2 in the final station. G4 indicates the start of secondary transfer of the page N2. H indicates the end of secondary transfer of the page N3. Sections L, M, and N are the same as those in (a) of FIG. 4. That is, in section L, the image of the page N1 is fixed at the speed $V_1$. In section M, the fixing unit speed changes from the speed $V_1$ to $V_2$. In section N, the images of the pages N2 and N3 are fixed at $V_2$. O, P, and Q are also the same as those in (a) of FIG. 4. That is, O indicates the start of image fixing of the page N1. P indicates the start of image fixing of the page N2. Q indicates the start of image fixing of the page N3. R indicates the end of image fixing of the page N3.

More specifically, primary transfer of the page N1 starts from $X_{1s}$ at the primary transfer position $T_{1a}$ at the primary transfer speed $V_1$ and ends at $X_{1e}$. Secondary transfer of the page N1 starts from $Y_{1s}$ at the secondary transfer position $T_2$ at the secondary transfer speed $V_1$ and ends at $Y_{1e}$. Image fixing of the page N1 starts from $Z_{1s}$ at the image fixing position $F_r$ at the fixing speed $V_1$ and ends at $Z_{1e}$. Primary transfer of the page N2 starts from $X_{2s}$ at the primary transfer speed $V_1$ at a position G3 spaced apart by $L_x$($L_x \geqq L_c$ and $L_x \geqq L_y$) from the primary transfer end position $X_{1e}$ of the page N1, and ends at $X_{2e}$. In this example, $L_y=L_c$ and $L_x=L_c$. After the secondary transfer speed changes from $V_1$ to $V_2$, secondary transfer of the page N2 starts from $Y_{2s}$ and ends at $Y_{2e}$. After the fixing speed changes from $V_1$ to $V_2$ after the end of fixing the image of the page N1, image fixing of the page N2 starts from $Z_{2s}$ at the image fixing position $F_r$ and ends at $Z_{2e}$. Similarly, primary transfer of the page N3 starts from $X_{3s}$ at the primary transfer speed $V_1$ and ends at $X_{3e}$. Secondary transfer of the page N3 starts from $Y_{3s}$ at the secondary transfer speed $V_2$ and ends at $Y_{3e}$. Image fixing of the page N3 starts from $Z_{3s}$ at the image fixing position $F_r$ at the fixing speed $V_2$ and ends at $Z_{3e}$.

The time taken to end image fixing of the page N3 after the start of primary transfer of the page N1 will be compared between the print reservation processes according to the prior art and embodiment.

As is apparent from FIG. 4A, the prior art and embodiment are equal in the time until image fixing of the page N1 ends after the start of primary transfer of the page N1 and the time until image fixing of the page N3 ends after the page N2 reaches the image fixing position $F_r$. The prior art and embodiment are different in the necessary time until the page N2 reaches the image fixing position $F_r$ after the end of image fixing of the page N1. This difference is related to the image interval between the pages N1 and N2 on the intermediate transfer member.

In the conventional print reservation process, after primary transfer and secondary transfer of the page N1 are performed at the print speed $V_1$ and the print speed changes to $V_2$, primary transfer and secondary transfer of the pages N2 and N3 are performed. The image interval between the pages N1 and N2 on the intermediate transfer member is $L_{t12}+L_c+L_m$ (time conversion: [$L_{t12}/V_2$]+[moving time for $L_c$]+[moving time for $L_m$]).

In the print reservation process according to the embodiment, primary transfer and secondary transfer of the pages N1, N2, and N3 are performed at the print speed $V_1$. Hence, the image interval between the pages N1 and N2 on the intermediate transfer member is $L_x$ (time conversion: [moving time for $L_y$])

More specifically, the image forming apparatus according to the embodiment can provide the user with printed materials earlier by the time corresponding to the length I shown in FIG. 4A (time conversion: $L_{t12}/V_2$+[moving time for $L_c$]+[moving time for $L_m$]−[moving time for $L_y$]). Generally, in the embodiment in which the transferred images of pages require the printer engine length $L_{t12}$ falling within the intermediate transfer member, [moving time for $L_y$] is smaller than [$L_{t12}/V_2$].

Change of the fixing unit speed will be described. When the page N1 is printed at the first print speed $V_1$ and the pages N2 and N3 are printed at the second print speed $V_2$, the image of the page N1 is fixed at the first print speed $V_1$. For this purpose, the fixing unit driving speed changes to the first print speed $V_1$ until the leading end of paper of the page N1 enters the fixing unit. The images of the pages N2 and N3 are fixed at the second print speed $V_2$. Thus, after the image of the page N1 is formed, i.e., the back end of paper of the page N1 passes through the fixing unit, the fixing unit driving speed changes to the second print speed $V_2$. The change of the fixing unit driving speed to the second print speed $V_2$ is complete before the start of fixing the image of the page N2, that is, until the leading end of paper of the page N2 enters the fixing unit. The images of the pages N2 and N3 are fixed at the designated second print speed $V_2$.

As described above, to fix each image at a designated print speed, the fixing unit, and the transfer unit including the primary and secondary transfer units are driven at different speeds. Hence, the transfer unit and fixing unit 10 are driven by separate diving sources.

When continuously printing while switching the speed, the image forming apparatus can execute the print reservation process according to the embodiment to achieve a primary transfer process capable of reducing an increase in time taken to switch the speed of the intermediate transfer member, in comparison with the prior art. The image forming apparatus can provide the user with printed materials more quickly.

FIG. 4B shows an example of the area 114 in FIG. 1C that is used in FIG. 4A. The area 114 stores the intermediate transfer member moving distance $L_c$ (moving time) necessary to change an intermediate transfer member speed $V_a$ to an intermediate transfer member speed $V_b$. Further, the area 114 stores the intermediate transfer member moving distance $L_y$ (moving time) necessary to change a fixing unit speed $V_a$ to a fixing unit speed $V_b$, and the image forming interval $L_x$ (moving time) when changing the intermediate transfer member speed. (b) of FIG. 4A shows various operation timings of only the pages N1 to N3. Primary transfer, secondary transfer, and fixing operation of the page N4 subsequent to the page N3 are executed at the second print speed.

Figure 4C:
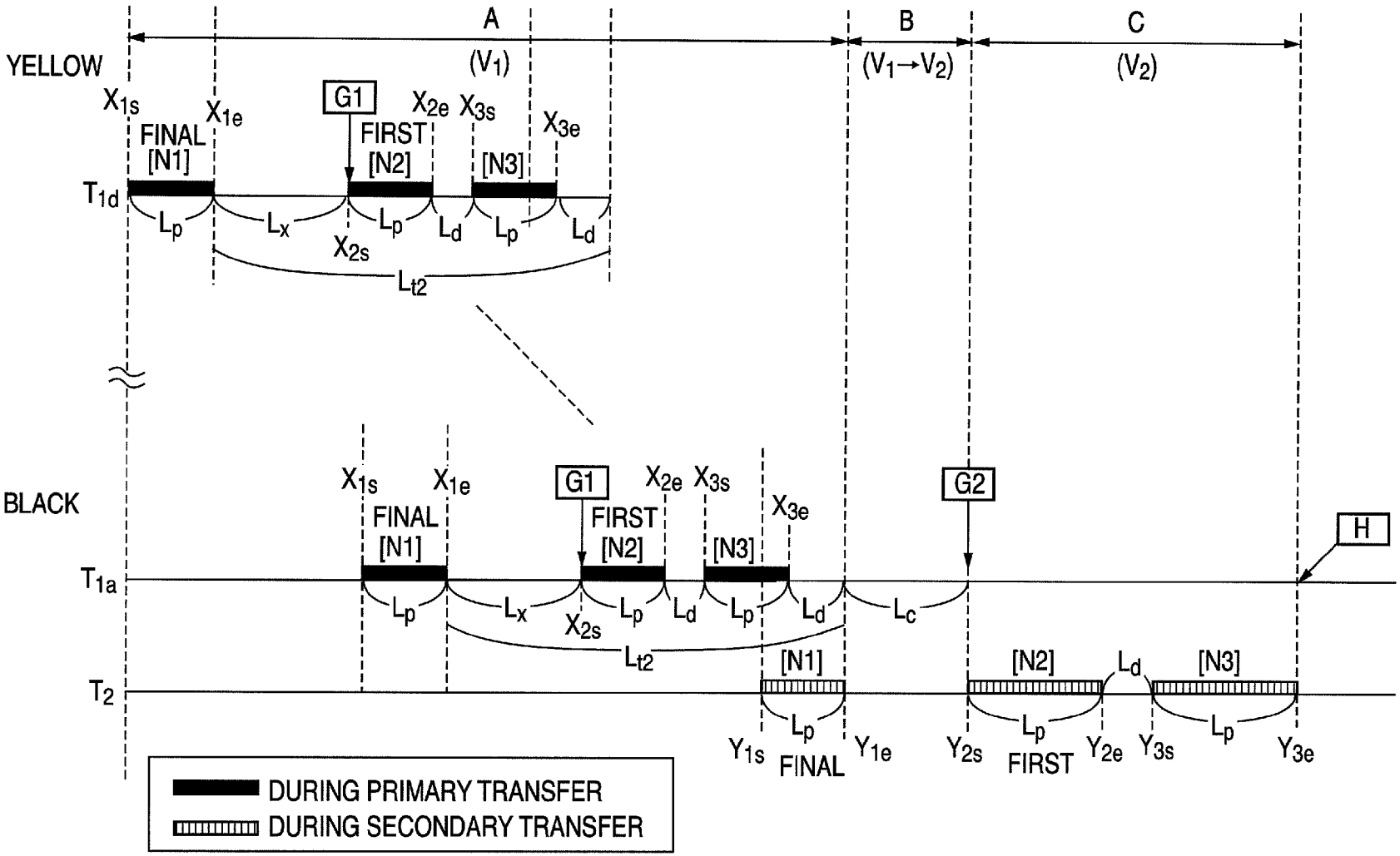
FIG. 4C is a view showing an actual time taken to end secondary transfer in the print reservation process according to the embodiment.

For descriptive convenience, FIGS. 4A and 4B show a comparison between the prior art and the embodiment for primary transfer and secondary transfer with black (K) when the speed of the intermediate transfer member changes. In a color image forming apparatus having a plurality of primary transfer units, a yellow image is first transferred onto the intermediate transfer member. The actual primary transfer start position (start timing) is a yellow (Y) start position, as shown in FIG. 4C. Also in FIG. 4C, the number N of images is determined based on the distance between the primary and secondary transfer positions for black.

[2. Number and Layout of Images Primarily Transferred Before Changing Speed]

An image forming method including switching of the fixing speed according to the embodiment will be described in detail. A method of calculating the number of images primarily transferable before changing the print speed, which has conventionally been formed after changing the speed, for a print job including speed change will be explained.

Inequality (1) below determines the number of images by which part of a print job including change of the print speed is to be primarily transferred at a print speed before changing the print speed. N which satisfies inequality (2) represents the number of images primarily transferable at the print speed before changing the print speed.

$$L_{t12} \geqq L_x + L_p \times N + L_d \times (N-1) \quad (1)$$

$$\therefore N \leqq (L_{t12} - L_x + L_d)/(L_p + L_d) \quad (2)$$

$L_{t12}$: distance from the transfer roller $T_{1a}$ of the final station of the primary transfer unit to the secondary transfer roller $T_2$ $L_p$: length of the image size in the sub scanning direction $L_d$: image interval (paper interval) between images at the same print speed on the intermediate transfer member $L_c$: intermediate transfer member moving distance to change the speed of the primary transfer unit from the first speed to the second one $L_y$: intermediate transfer member moving distance to change the fixing unit speed from the first speed to the second one $L_x$: intermediate transfer member moving distance to change the print speed from the first speed to the second one (minimum $L_y$ which satisfies $L_x \geqq L_c$ and $L_x \geqq L_y$)

N: number of images

The meanings of inequalities (1) and (2) will be explained below.

The left-hand side of inequality (1) represents the distance $L_{t12}$ by which the intermediate transfer member moves until a toner image formed at the print speed $V_1$ is primarily transferred onto the intermediate transfer member by the final station and then secondarily transferred. The right-hand side of inequality (1) represents the sum of the distance $L_x$ by which the intermediate transfer member moves until the print speed changes from the first speed $V_1$ to the second speed $V_2$, and an intermediate transfer member distance necessary to primarily transfer N images onto the intermediate transfer member at the image interval of $L_d$ at the second speed $V_2$. Inequality (2) derived from inequality (1) exhibits the number of images primarily transferable at the first speed $V_1$ out of print job images printed at the second speed until the end of secondary transfer after the end of primarily transferring, at the first speed, the final image to be printed at the first speed. Images primarily transferred at the first speed $V_1$ are secondarily transferred after the print speed changes to the second speed $V_2$. Thus, inequalities (1) and (2) can determine the number of images by which part of a print job including change of the print speed is to be primarily transferred at a print speed before changing the print speed.

Assuming that $L_{t12}=1000$, $L_p=250$, $L_x=400$, and $L_d=50$, $$N \leqq (1000-400+50)/(250+50) = 650/250 = 2.6$$

From this, N=two images, which meet inequality (2), are formed at the primary transfer speed before changing the print speed. This can reduce an increase in image forming time upon changing the print speed, as compared with the prior art.

The following inequality is applied to a case where successively fed printing media have different lengths in the conveying direction. The same precision as that of inequality (1) can be maintained by applying inequality (3) below to even a case where the length in the conveying direction is different between formed images or the image interval is different:

$$L_{t12} \geqq L_x + (L_{p1} + L_{p2} + L_{p3} \ldots + L_{pN}) + (L_{d1} + L_{d2} + L_{d3} \ldots + L_{dN-1}) \quad (3)$$

where $L_{p1}, L_{p2}, L_{p3}, \ldots, L_{pN}$ represent the lengths of toner images transferred onto the first to Nth printing media in the conveying direction (subscanning direction), and $L_{d1}, L_{d2}, L_{d3}, \ldots, L_{dN-1}$ represent the image interval between the first and second printing media to that between the (N−1)th and Nth printing media. The length of a toner image corresponding to each printing medium in the conveying direction and the image interval are defined in this manner. The number of images to be formed at a speed before change can be determined in more detail.

[3. Print Reservation Process Including Switching of Fixing Speed: FIG. 2]

The sequence of a print reservation process including switching of the fixing speed according to the embodiment will be explained. FIG. 2 is a flowchart for explaining a primary transfer process for reducing an increase in image forming time in a print reservation schedule including switching of the fixing speed according to the embodiment. In the embodiment, part of an image, which is primarily transferred after changing the transfer speed to the secondary one in the prior art, is primarily transferred at a primary transfer speed before change. For this purpose, output of a TOP signal (image print start signal) is switched before switching the primary transfer speed. This can reduce an increase in image forming time upon switching the fixing speed, as compared with the prior art. The CPU 101 executes the process in FIG. 2 by using the RAM 103 as a work area while controlling respective units based on an image formation control program stored in the ROM 102 shown in FIG. 1B.

In step S1, the print operation starts. Then, the process advances to step S2, and the CPU 101 controls to start rotating the photosensitive drum, ITB, and the like, and prepares for the print operation.

The process advances to step S3, and the CPU 101 checks whether the current fixing speed is equal to the print speed of the next print reservation to start primary transfer. The CPU 101 performs the process in step S3 using a print job (image data) sent from a video controller to the printer engine via a video interface or the like, and print job information (image size, type of printing medium for use, and print speed). If a print speed is designated, it is adopted. Alternatively, change of the print speed is determined based on the type of printing medium. If the CPU 101 determines in step S3 that no print speed has changed, the process advances to step S4.

If the CPU 101 determines in step S3 that the print speed has changed, the process advances to step S6. In step S6, the CPU 101 calculates the number of images to be primarily transferred at the current fixing speed before setting the print speed again. The CPU 101 calculates the TOP signal output timing of images to be primarily transferred at the current fixing speed, and the primary transfer speed switching timing. The process advances to step S7, and the CPU 101 sets the number of images to be primarily transferred at the current fixing speed.

The process advances to step S8, and the CPU 101 determines whether the set number of images is 0. If the set number of images is not 0, the process advances to step S9, and the CPU 101 controls to output the calculated TOP signal to the printer engine. The process advances to step S10, and the CPU 101 controls to primarily transfer an image. Then, the process advances to step S11 to set N=N−1, and returns to step S8.

If the set number of images is 0 in step S8, the process advances to step S12, and the CPU 101 waits until the completion of secondarily transferring a preceding image in order to cause the printer engine to switch the transfer speed. Upon completion of secondary transfer, the process advances to step S13, and the CPU 101 causes the printer engine to switch the primary transfer speed. Then, the process advances to step S4.

In step S4, the CPU 101 controls to output a TOP signal corresponding to the image data. The process advances to step S5, and the CPU 101 controls to primarily transfer, to the intermediate transfer member, a toner image formed on the photosensitive drum. The process advances to step S14, and the CPU determines whether to end the process. If the process is to continue, the process returns to step S3. If the process is to end, it advances to step S15 to end a series of work operations.

[Determination of Speed Switching Timing of Primary Transfer Unit: FIG. 3]

The exemplary processes in steps S6 to S13 of FIG. 2 will be described. As a concrete example, as for the images of the pages N1 to N3 having the same image size as shown in FIGS. 3 and 4A, the page N1 is printed at the first print speed $V_1$, and the pages N2 and N3 are printed at the second print speed $V_2$.

In step S6, the CPU 101 calculates N using inequality (2). Assuming that $L_{t12}$=1000, $L_p$=250, $L_x$=400, and $L_d$=50, "2" is derived as N which satisfies inequality (2). That is, two images are primarily transferable before changing the speed. Based on the calculated N (=2), the CPU 101 calculates the TOP signal so as to primarily transfer two images at a speed before changing the transfer speed. Also, the CPU 101 sets the transfer speed switching timing. In step S7, the CPU 101 sets N=2. Since N≠0 in step S8, the process advances to step S9. In step S9, the CPU 101 outputs a TOP signal corresponding to the image of the page N2 so as to primarily transfer the image of the page N2 at the position G1 in FIG. 4A. In step S10, the CPU 101 primarily transfers the image of the page N2. In step S11, the CPU 101 sets N=1, and returns to step S8. In steps S8 to S11 described above, the CPU 101 primarily transfers the image of the page N3, sets N=0, and returns to step S8. Since N=0 in step S8, the process advances to step S12 and waits until the completion of secondarily transferring a preceding image (image of the page N2). After that, the process advances to step S13 to switch the speed.

In this way, the image forming apparatus according to the embodiment transfers the images of the pages N2 and N3 onto the intermediate transfer member before switching the speed. After the speed reaches the target speed, the images of the pages N2 and N3 are secondarily transferable. Change of the speeds of the primary transfer unit and intermediate transfer member in step S13 suffices to start from at least $L_c$ before the secondary transfer roller $T_2$.

According to the first embodiment, when continuously printing while switching the speed, the image forming apparatus can execute primary transfer without wasting the time taken to switch the speed of the intermediate transfer member. The image forming apparatus can provide the user with printed materials more quickly.

Second Embodiment

The second embodiment will now be described. An image forming apparatus in the second embodiment is similar to that in the first embodiment. Hence, only a difference of the image forming apparatus in the second embodiment from that in the first embodiment will be explained. A description of the common part will not be repeated.

[Features]

The first embodiment has described the process to reduce an increase in print time when the print speed is switched during continuous printing. In the second embodiment, even when a print job received from a video controller does not include switching of the print speed, the primary and secondary transfer speeds can be appropriately changed in accordance with print job information and the printer engine status. That is, according to the second embodiment, when a designated print speed is lower than the highest print speed of the image forming apparatus, it can be changed to a higher primary transfer speed. After primary transfer at the higher primary transfer speed, secondary transfer can be done by decreasing the secondary transfer speed to the designated print speed. In this way, when a designated print speed is lower than the highest print speed of the image forming apparatus, the primary and secondary transfer speeds are properly switched. The second embodiment can shorten the time taken to convey a primarily transferred image for secondary transfer. Since secondary transfer and image fixing can be done at the designated print speed, the image forming apparatus can provide the user with printed materials more quickly without degrading their image quality.

[Process to Change Designated Print Speed to Higher Primary Transfer Speed]

A speed change process will be described. According to this process, when a print speed designated by a print job including no switching of the print speed is lower than the highest print speed of the image forming apparatus, the secondary transfer speed is set to the designated print speed, and the primary transfer speed is set to a higher speed.

Figure 6:
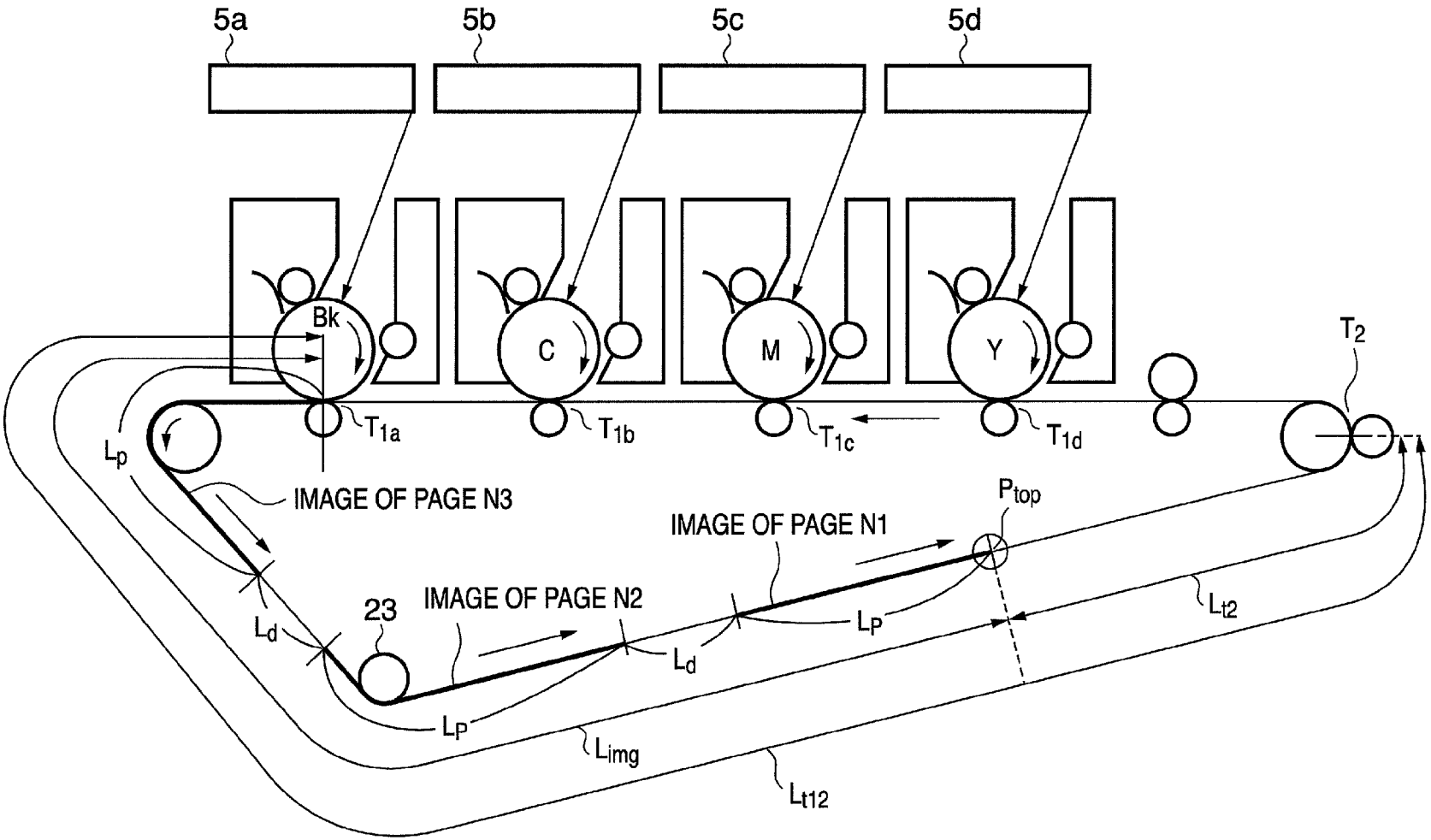
FIG. 6 is a sectional view for explaining a process from primary transfer to secondary transfer in the image forming apparatus according to the second embodiment.

FIG. 6 is a sectional view showing the positional relationship between the primary transfer position, intermediate transfer member, and secondary transfer position (printing medium transfer position) associated with a process from primary transfer to secondary transfer in the image forming apparatus. FIG. 6 is similar to FIG. 3 described in the first embodiment. The same reference numerals as in FIG. 3 denote the same parameters, and only differences will be explained.

In FIG. 6, $L_{t2}$ represents the distance from a leading end $P_{top}$ of the first toner image on the intermediate transfer member to the secondary transfer position $T_2$. $L_{img}$ represents the distance from the transfer roller $T_{1a}$ of the final station of the primary transfer unit to $P_{top}$ where primary transfer of up to the Nth page ends. $L_{img}$ is given by $$L_{img}=L_d\times N+L_d\times(N-1) \tag{4}$$

Inequality (5) is established when primary transfer can be performed at a speed VT1 higher than a print speed $V_j$ designated by print reservation to shorten the time taken to convey a primarily transferred image to the secondary transfer position:

$$(L_{t12}-L_{img})\geqq L_c \tag{5}$$

In this case, $L_{t2}$ obtained by subtracting $L_{img}$ from the distance $L_{t12}$ from the final primary transfer roller $T_{1a}$ to the secondary transfer roller $T_2$ is larger than the distance $L_c$ necessary to switch the speeds of the primary transfer unit and intermediate transfer member.

When inequality (5) is established, for example, when the printer engine can execute primary transfer at a speed three times higher than the speed $V_j$ designated by print reservation, the time taken to form a toner image on the intermediate transfer member can be shortened to ⅓ of the time taken to form an image on the intermediate transfer member at the designated speed $V_j$.

Inequality (6) is derived by substituting equation (4) into inequality (5). The second embodiment does not consider switching of the fixing unit speed, so inequality (6) is attained by replacing $L_x$ in inequality (1) with $L_c$. In other words, when $L_x=L_c$, inequality (5) has the same meaning as that of inequality (1)

$$L_{t12} \geqq L_c + L_p \times N + L_d \times (N-1) \quad (6)$$

As described in the first embodiment, inequality (1) yields the number N of images by which part of a print job including change of the print speed is to be primarily transferred at a print speed before changing the print speed. The second embodiment can also perform the same process as that in the first embodiment.

That is, even if secondary transfer is done at a designated speed, the primary transfer speed is changed to be higher than the secondary transfer speed. Then, N images, which satisfy inequality (1) as shown in FIG. 6, are formed at the higher primary transfer speed. At $P_{top}$ in FIG. 6, the rotation speed of the intermediate transfer member is changed to the designated speed. The designated speed can be attained at the secondary transfer roller $T_2$, and thus the N images can be transferred at the designated secondary transfer speed.

Figure 5:
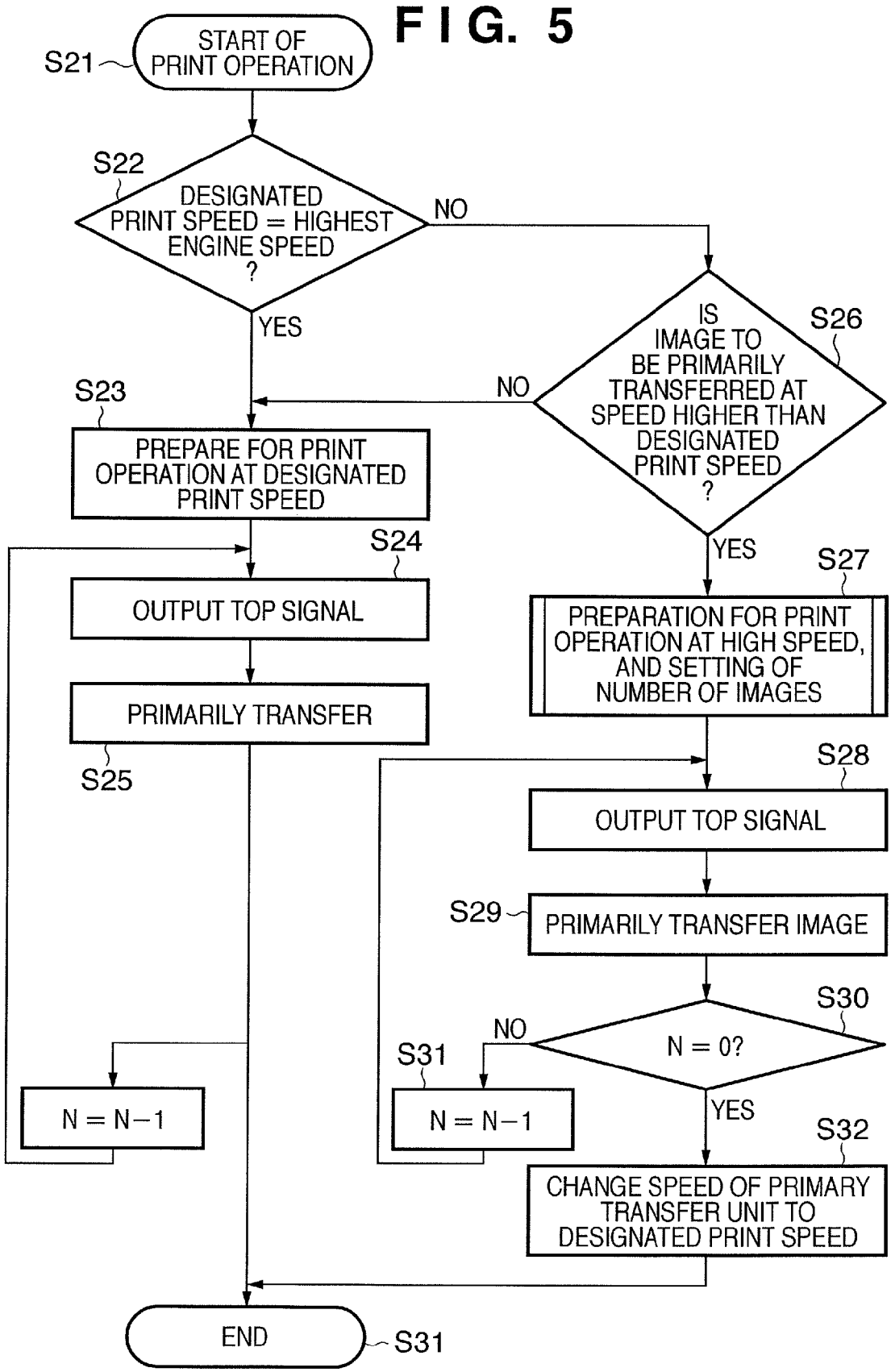
FIG. 5 is a flowchart for explaining a primary transfer process in an image forming apparatus according to a second embodiment.

[Print Reservation Process Including No Switching of Fixing Speed: FIG. 5]

A process to switch the primary and secondary transfer speeds in a print reservation process including no switching of the fixing speed according to the second embodiment will be explained.

FIG. 5 is a flowchart for explaining print operation preparation in a print reservation schedule including no switching of the print speed, output of a TOP signal from the CPU, and an operation to switch the speeds of the primary transfer unit and intermediate transfer member of the image forming apparatus according to the second embodiment.

A CPU 101 which controls the printer engine executes the process in FIG. 5 by using a RAM 103 as a work area while controlling respective units on the basis of an image formation control program stored in a ROM 102 shown in FIG. 1B. The process in FIG. 5 ends when all images up to that of the Nth page to be printed have been primarily transferred, and the primary transfer unit and intermediate transfer member operate at a print speed designated by print reservation (step S31).

In step S21, if the image forming apparatus changes from a print-unreserved state to a print-reserved state upon accepting the print reservation of the printer engine from the video controller, the CPU controls to start the print operation.

The process advances to step S22, and the CPU checks whether the print speed $V_j$ designated in print reservation is a highest print speed $V_h$ of the printer engine. If the designated print speed $V_j$ equals the highest print speed $V_h$ of the printer engine, the process advances to step S23, and the CPU controls to start driving the primary transfer unit and intermediate transfer member at the highest print speed and prepare for the print operation.

The process advances to step S24, and the CPU outputs a TOP signal at a predetermined (preset) timing. The process advances to step S25, and the CPU controls to primarily transfer toner images of respective colors sequentially onto the intermediate transfer member.

The process returns to step S24, and the CPU controls to end primary transfer after repeating the processes in steps S24 and S25 by the number N of print pages. Then, a series of work operations ends.

If the CPU determines in step S22 that $V_j$ is not the highest print speed, the process advances to step 826. The CPU determines whether to execute primary transfer at the speed VT1 ($VT1>V_j$ and $VT1 \leqq V_h$) different from the designated print speed $V_j$.

If the CPU determines in step S26 to execute primary transfer at VT1, the process advances to step S27, and the CPU prepares for the print operation at VT1 and sets the number of images. In step S27, the CPU performs a process corresponding to those in steps S6 and S7 of FIG. 2 described in the first embodiment. That is, in step S27, the CPU 101 calculates the number N of images to be primarily transferred at the print speed VT1 and sets the calculated number of images (N=N). The CPU 101 calculates the TOP signal output timing of an image to be primarily transferred at the print speed VT1 and the primary transfer speed switching timing. In step S27, the CPU 101 prepares for primary transfer by changing the designated print speed $V_j$ to the higher primary transfer speed VT1.

The CPU outputs the TOP signal of an image to be primarily transferred at the print speed VT1 in step S28, and controls to primarily transfer the image in step S29. In step S30, the CPU checks the number N of images. If N is not 0, the process advances to step S31 to set N=N−1, and returns to step S28. The CPU performs the processes in steps S28 and S29 N times, and then advances to step S32. In step S32, the CPU returns the print speed VT1 to the designated print speed $V_j$.

If the CPU determines in step S26 to execute primary transfer at the designated print speed, the process advances to step S23. In step S23 and subsequent steps, the CPU performs the same process as that when the designated print speed $V_j$ checked in step S22 equals the highest print speed $V_h$. The speed at which the fixing unit prepares for preparation and fixes an image complies with a print speed designated in print reservation regardless of the determination result of step S22 or S26.

The second embodiment executes the print operation by appropriately switching the primary print speed in accordance with print job information and the printer engine status. The second embodiment can shorten the time taken to secondarily transfer a primarily transferred image. Since an image can be fixed at a designated print speed, the image forming apparatus can provide the user with printed materials more quickly without degrading the image quality.

Third Embodiment

The third embodiment will now be described. An image forming apparatus in the third embodiment is similar to that in the first embodiment. Hence, only a difference of the image forming apparatus in the third embodiment from that in the first embodiment will be explained. A description of the common parts will not be repeated.

[Features]

The third embodiment is related to a process after the print reservation schedule changes, for example, a new print reservation is added to the print reservation accepted from a video controller, or an accepted print reservation is canceled. The TOP signal output timing and primary print speed are changeable in accordance with the print reservation schedule after the print reservation of an image whose TOP signal has been output. Since the timing or primary print speed can be changed in accordance with change of the print reservation schedule, the image forming apparatus can achieve a throughput optimum for the situation.

In the third embodiment, assume that the printer engine accepts the print reservation of up to the Nth page. Also assume that the print reservation of a new (N+1)th page is added before the TOP signal output timing of the Nth page, or the print reservation of a page before the Nth page is canceled.

Figure 7:
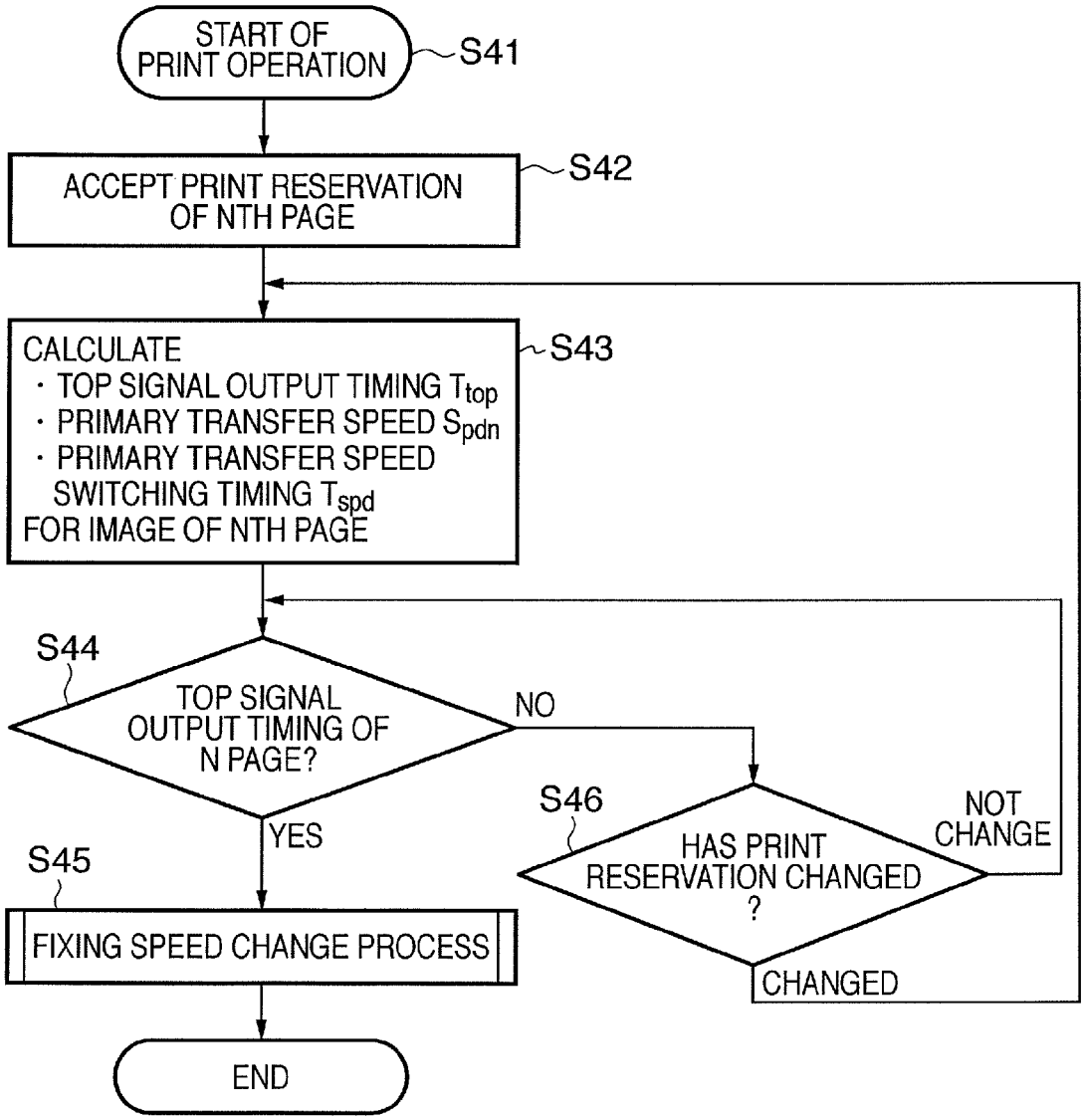
FIG. 7 is a flowchart for explaining a primary transfer process in an image forming apparatus according to a third embodiment.

FIG. 7 is a flowchart for explaining the TOP signal output timing of the Nth page, the primary transfer speed of an image, and the primary transfer speed switching timing upon changing the print reservation list according to the third embodiment.

In step S41, if the printer engine changes from a print-unreserved state to a print-reserved state, the print operation starts. In step S42, the printer engine accepts the print reservation of the Nth page during printing.

The process advances to step S42 to determine the TOP signal output timing of the print image of the Nth page, the primary transfer speed, and the primary transfer speed switching timing upon accepting the print reservation of the Nth page. The process in step S43 corresponds to the fixing speed change process in steps S6 and S7 of FIG. 2 described in the first embodiment. That is, when changing the printer speed, a CPU 101 calculates in step S43 the number N of images to be primarily transferred at the print speed VT1, and sets the calculated number of images (N=N). The CPU 101 calculates the TOP signal output timing of an image to be primarily transferred at the print speed VT1, and the primary transfer speed switching timing. The process advances to step S44, and the CPU 101 monitors the TOP signal output timing of the Nth page. If the TOP signal output timing has not come, the process advances to step S46, and the CPU 101 checks whether the print reservation has changed.

If no print reservation has changed in step S46, the process returns to step S44 again, and the CPU 101 continues to monitor the TOP signal output timing. If the print reservation has changed in step S46, the process returns to step S43. In step S43, the CPU 101 determines again in step S43 the TOP signal output timing of the Nth page, the primary transfer speed, and the primary transfer speed switching timing so as to increase the throughput of all accepted print reservations including a new print reservation.

If the TOP signal output timing of the Nth page has come in step S44, the process advances to step S45. The process in step S45 is the image transfer speed change process in steps S8 to S13 and subsequent steps S4 and S5 described in the first embodiment.

The third embodiment executes the print operation by appropriately switching the primary transfer speed even during the print operation in accordance with the print reservation list. The third embodiment can shorten the time taken to secondarily transfer a primarily transferred image. Since an image is fixed at a designated print speed, the image forming apparatus can provide the user with printed materials more quickly without degrading the image quality.

As described in the first to third embodiments, the image forming apparatus which performs primary transfer and secondary transfer in parallel with each other can determine the TOP signal output timing and primary print speed which maximize the throughput of the printer engine. The image forming apparatus can shorten the print time in printing including speed switching and also in normal printing free from any speed switching. The image forming apparatus can provide the user with printed materials as quickly as possible.

Other Embodiments

The object of the present invention is also achieved by supplying a storage medium which stores software program codes for implementing the functions of the above-described embodiment to a system or apparatus. In this case, the computer (or the CPU or MPU) of the system or apparatus reads out and executes the program codes stored in the storage medium.

In this case, the program codes read out from the storage medium implement the functions of the above-described embodiment, and the program codes and the storage medium which stores the program codes constitute the present invention.

The storage medium for supplying the program codes includes a Floppy® disk, hard disk, magnetooptical disk, CD-ROM, CD-R, and CD-RW. The storage medium also includes a DVD-ROM, DVD-RAM, DVD-RW, DVD+RW, magnetic tape, nonvolatile memory card, and ROM. The program codes may also be downloaded via a network.

The functions of the above-described embodiment are implemented by executing the readout program codes by the computer. Also, the present invention includes a case where an OS (Operating System) or the like running on the computer performs some or all of actual processes based on the instructions of the program codes and thereby implements the functions of the above-described embodiments.

Furthermore, the present invention includes a case where the functions of the above-described embodiments are implemented as follows. That is, the program codes read out from the storage medium are written in the memory of a function expansion board inserted into the computer or the memory of a function expansion unit connected to the computer. After that, the CPU of the function expansion board or function expansion unit performs some or all of actual processes based on the instructions of the program codes.

In this case, the program is supplied directly from the storage medium which stores the program, or downloaded from another computer, database, or the like (not shown) connected to the Internet, a commercial network, a local area network, or the like.

The embodiment has exemplified an electrophotographic image forming apparatus. However, the present invention is not limited to electrophotographic printing, and can also be applied to a variety of printing methods such as inkjet printing, thermal transfer printing, thermal printing, electrostatic printing, and electrosensitive printing.

The program may take the form of an object code, a program code executed by an interpreter, script data supplied to the OS (Operating System), or the like.

The present invention can provide an image forming apparatus capable of adjusting the image sync signal output timing in the subscanning direction and the speed of a primary transfer process so as to obtain a proper throughput of a printer engine when successively forming images, and a control method therefor. For example, upon receiving a print job including switching of the print speed, the image forming apparatus can perform adjustment to obtain a proper throughput of the printer engine. Even if a designated print speed is not the highest print speed of the image forming apparatus, the image forming apparatus can perform adjustment to obtain an appropriate throughput of the printer engine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-261417 filed on Sep. 26, 2006, Application No. 2007-223093 filed on Aug. 29, 2007, and, Application No. 2007-177558 filed on Jul. 5, 2007, which are hereby incorporated by reference herein in their entirety.

What is claimed is:

1. An image forming apparatus including a primary transfer unit that primarily transfers an image on an image carrier onto an intermediate transfer member, and a secondary transfer unit that secondarily transfers the primarily transferred image on the intermediate transfer member onto a printing medium, the apparatus comprising:

a speed change unit that changes a speed of the intermediate transfer member from a first speed to a second speed, when the secondary transfer unit secondarily transfers the image onto a printing medium; and a control unit that controls a transfer operation, when the speed of the intermediate transfer member is changed from the first speed to the second speed, so that the primary transfer unit primarily transfers a first image and a second image onto the intermediate transfer member with the first speed and secondarily transfers the first image onto the printing medium at the first speed by the secondary transfer unit and secondarily transfers the second image onto the printing medium at the second speed by the secondary transfer unit, wherein the control unit controls an image interval distance between a back end of the first image and a leading end of the second image when the primary transfer unit primarily transfers the first image and the second image onto the intermediate transfer member with the first speed so that the image interval distance is an interval distance (i) equal to or greater than a moving distance of the intermediate transfer member needed to change the speed of the intermediate transfer member from the first speed to the second speed and (ii) less than a moving distance traveled by a full rotation of the intermediate transfer member.

2. The apparatus according to claim 1, wherein the control unit controls, by use of the speed change unit, the speed of the intermediate transfer member from the first speed to the second speed after a final image secondarily transferred onto the printing medium at the first speed is transferred.

3. The apparatus according to claim 2, wherein an initial image of images secondarily transferred at the second speed is secondarily transferred onto the printing medium immediately after the speed change unit changes the speed of the intermediate transfer member to the second speed.

4. The apparatus according to claim 2, wherein when the secondary transfer is executed, the speed of the intermediate transfer member is changed depending on a type of the printing medium.

5. The apparatus according to claim 2, further comprising a receiving unit that receives image forming information for forming the image, wherein the control unit sets the image interval based on the image forming information received by the receiving unit.

6. The apparatus according to claim 1, wherein when the first speed is lower than a highest rotation speed, said control unit changes the first speed to the highest rotation speed.

7. The apparatus according to claim 1, wherein the control unit controls a primary transferring operation so as to primarily transfer N images calculated by $$L_{t12} \geqq L_x + (L_{p1} + L_{p2} + L_{p3} \ldots + L_{pN}) + (L_{d1} + L_{d2} + L_{d3} \ldots + L_{dN-1})$$

onto the intermediate transfer member with the first speed before the speed change unit changes the speed of the intermediate transfer member to the second speed, where N is the number of images, $L_{t12}$ is a moving distance of the intermediate transfer member from a position of primary transfer to a position of secondary transfer, $L_{p1}$, $L_{p2}$, $L_{p3}$, . . . , $L_{pN}$ are lengths of printing media in a conveying direction of the intermediate transfer member, $L_{d1}$, $L_{d2}$, $L_{d3}$, . . . , $L_{dN-1}$ are conveying intervals of the printing media, and $L_x$ is an image interval from an end of the primary transferring of the first image secondarily transferred at the first speed to a beginning of the primarily transferring of the second image secondarily transferred at the second speed.

* * * * *